US005152632A

United States Patent [19]

Hawkes

[11] Patent Number: 5,152,632

[45] Date of Patent: Oct. 6, 1992

[54] SELF-GUIDANCE BICYCLE TRACK

[76] Inventor: E. Gerry Hawkes, c/o ECO Systems, Inc., R.F.D. 1, Box 247, Woodstock, Vt. 05091

[21] Appl. No.: 740,786

[22] Filed: Aug. 6, 1991

[51] Int. Cl.[5] ..... E01C 1/00

[52] U.S. Cl. ..... 404/20; 404/71

[58] Field of Search ..... 404/1, 20, 71; 104/20; 193/40, 32

[56] References Cited

U.S. PATENT DOCUMENTS 830,853 9/1906 Thompson ..... 193/40

*Primary Examiner*—William P. Neuder

*Attorney, Agent, or Firm*—Sughrue, Mion, Zinn, Macpeak & Seas

[57] ABSTRACT

A self-guidance bicycle track is formed of a plurality of longitudinally aligned, end-to-end coupled, upwardly open U-shaped molded plastic track sections, each track section has a generally flat, central traction portion and integral, upwardly oppositely facing concave side walls. The central traction portion is recessed below the upwardly concave, laterally opposed sidewalls. The sidewalls terminate in reversely curved, outwardly directed lips. Longitudinally spaced, transverse narrow slots within the molded track central traction portion permit rain water accumulating on the track to drain and surface grit to pass therethrough. Recessing of the traction surface below the lower ends of the concave sidewalls form lateral abutments which prevent a bicycle rear wheel from wandering off the traction surface without inhibiting side-to-side motion of the bicycle front wheel. U-shaped support brackets having an upper surface configured to the underside of the upwardly open, molded plastic, U-shaped track section which snap onto and are supported by the brackets. Tubular leg sockets mounted in the terrain, aligned with the support bracket legs slidably receive the legs. Split head clamps bolted together about the support bracket legs function as stops to limit penetration of the support bracket legs in the in-ground sockets receiving the same. Collars on the sockets bearing set screws prevent the bracket legs from accidentally lifting out of the tubular leg sockets.

18 Claims, 4 Drawing Sheets

FIG. 2
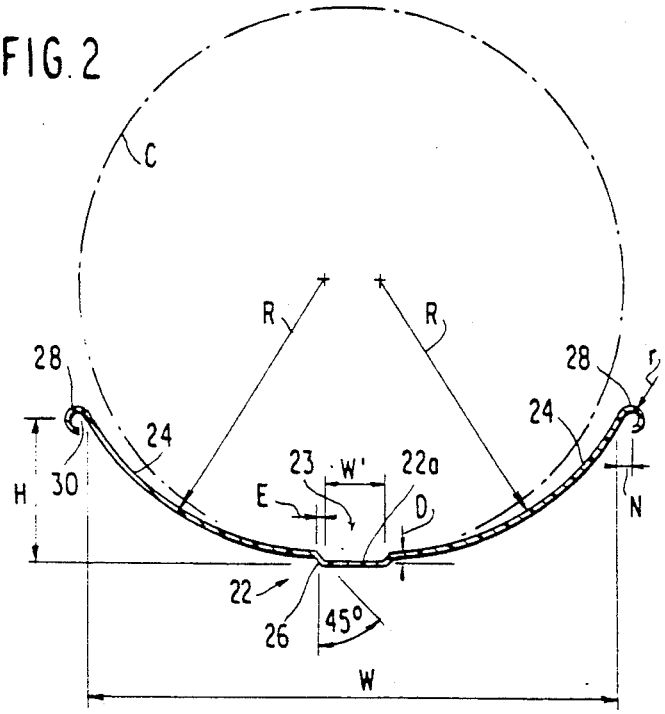
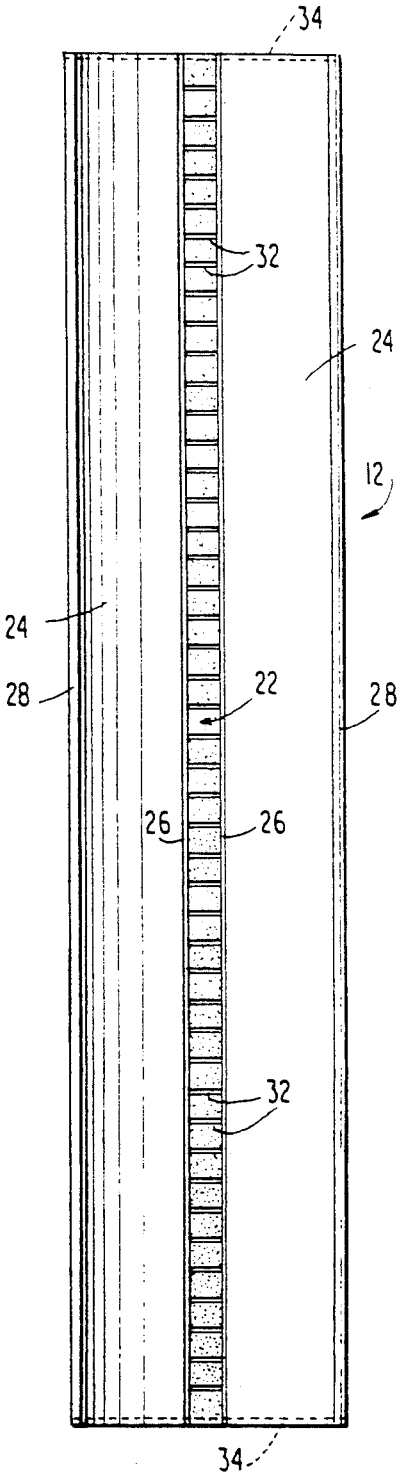
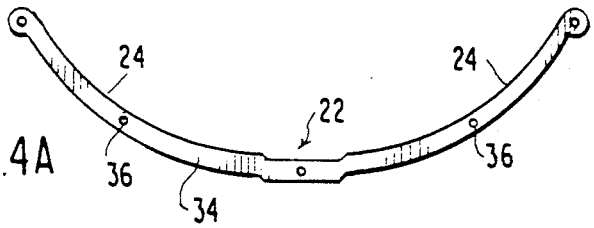
FIG. 4A
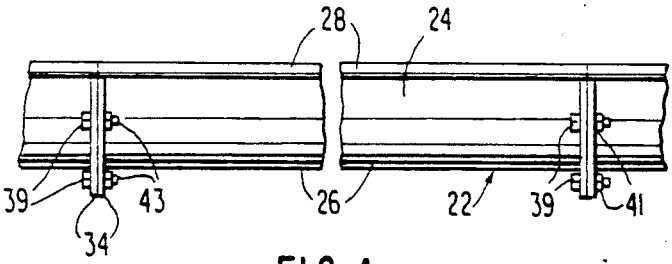
FIG. 4

FIG. 9
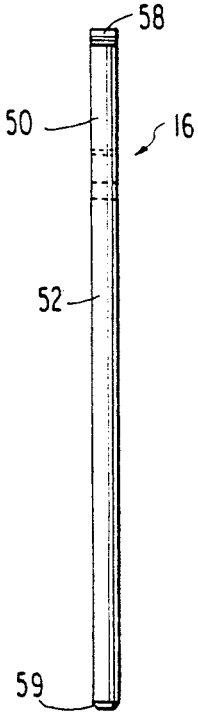
FIG. 11
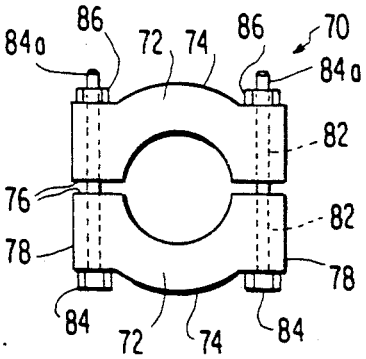
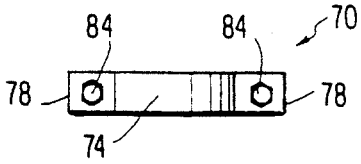
FIG. 12
FIG. 10
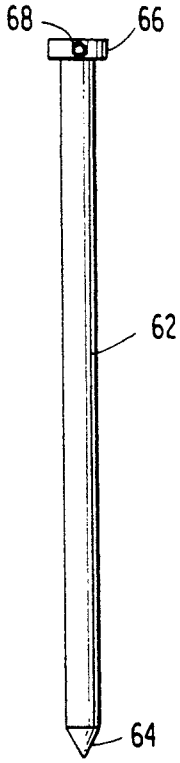
FIG. 13
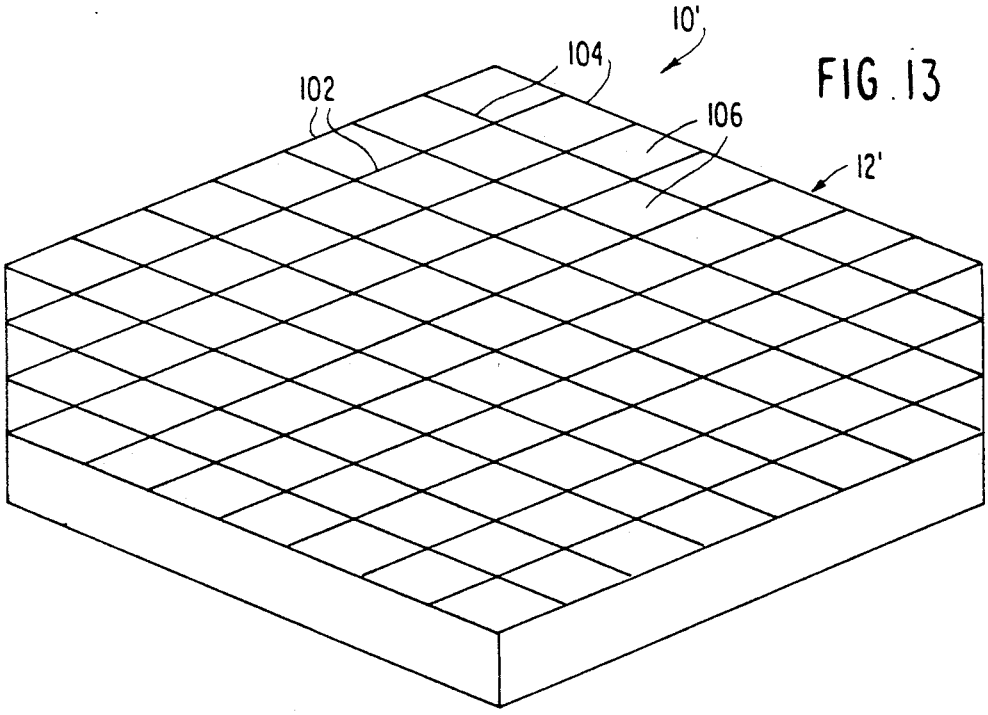

SELF-GUIDANCE BICYCLE TRACK

FIELD OF THE INVENTION

This invention relates to bicycle tracks and more particularly to a bicycle track having a degree of self-guidance and a traction portion for improving the performance characteristics of the track.

BACKGROUND OF THE INVENTION

It is obvious from the rapidly worsening damage to human health and the environment from automobile emissions, that prompt action must be taken to encourage non-polluting forms of transportation. Bicycles are an obvious means of efficient, non-polluting local transportation. There is an urgent need for a safe, efficient, economical, non-disruptive bicycle transportation system in view of the inability of current transportation systems to meet the needs of the citizenry. Additionally, since bicycling is an excellent form of exercise, such bicycle track would serve dual purposes in improving the health of the users and relieving the clogged highways, particularly in the urban and city areas.

Bicycle paths to date have been little more than earthen paths running along the side of the highways. As an improvement within that art, macadam bicycle paths of the paved type have been attempted. However, to lay such bicycle paths conforming to the standards published by the American Association of State Highway and Transportation officials, one-way bicycle paths 1.5 m wide require heavy construction equipment to rough out the path, the necessity of an adequate stone or other subsurface base for the macadam overlay and some type of banking at the turns. Such macadam bicycle paths are expensive, permanent and aesthetically unpleasing.

Unfortunately, the existing transportation networks in many parts of the world are not designed for safe or efficient use of bicycles. In the cities, the streets are clogged with automobiles, trucks, motorcycles and the like. In the suburban and country areas, the speeds of the automobiles travelling the roadways are a constant threat to the bicyclists who now use the edges of the highways. Thus, there is an urgent need for a bicycle transportation system which is safe and efficient to ride, easy and economical to install and does not cause disruption to existing natural or manmade terrain features.

There has been little patent activity in the building of prefabricated multi-component tracks or paths capable of or specifically defined for bicycle transport.

U.S. Pat. No. 4,176,982 is directed to a bicycle path transport system consisting essentially of laterally spaced parallel rails having grooves on facing sides within which are positioned a plurality of end-to-end runners. The runners, which are of flexible sheet material, are provided with drain holes to drain off rain water or the like accumulating within the transport system rail and runner structure.

U.S. Pat. No. 4,928,601 is directed to a structure attachable to the rear of a bicycle for preventing an overtaking bicycle from riding up onto a lead bicycle riding along a track system.

U.S. Pat. No. 4,172,593 is directed to a roller skating rink, particularly for use by skateboarding enthusiasts, with the rink having a length of approximately 250 feet and a width of less than half of that. Such structure may be prefabricated and set up on site. The roller skating rink is particularly directed to a generally FIG. 8 shaped track having portions which are raised relative to the others at crossing points.

U.S. Pat. No. 1,445,083 is directed to a ceramic tile having an anti-slipping or abrasive surface in the form of abrasive granules embedded in the outer face or tread portion of the tile.

While these patents tend to show some interest in the creation of a fabricated, or a prefabricated sectional bicycle path transport system, they do not appear to treat the needs of the populace, which involves the construction of a bicycle path, treating aspects of cycler safety, easy and quick installation, ready application to various terrain surfaces without the need for excavation and presurface treatment.

It is therefore a primary object of the present invention to provide an improved bicycle track having a degree of self-guidance for the bicycles traversing the same, with the track configuration and structural makeup enhancing the safety and cycling efficiency of the bicycle riders, which bicycle track can be prefabricated sectionally, quickly installed and removed as needed, which provides a smooth surface for the bicycle wheels, which has excellent traction, which eliminates excavation, soil compaction, rutting and erosion common to unimproved trails, which can be suspended for passage across small gullies, streams and ground irregularities, which is not subject to heaving or cracking due to frost or growth of tree roots, and which permits passing of bicycles travelling in the same direction and ease in entry and exiting of bicycles from the track at various locations.

SUMMARY OF THE INVENTION

The self-guidance bicycle track of the present invention may be of continuous unitary form, but preferably comprises a plurality of longitudinally aligned end-to-end connected, upwardly open U-shaped track sections. Such track sections are preferably of molded rigid plastic (but may be of a semi-flexible mesh design and made of other suitable materials) consisting of a generally flat central traction portion and integral, upwardly, oppositely facing concave sidewalls to laterally opposite sides thereof. The rigid, firm track has higher sidewalls than the central traction portion. Preferably, the traction portion is recessed below the upwardly concave laterally opposed sidewalls. The sidewalls preferably terminate in reversely curved, outwardly directed lips. The ends of the track sections preferably terminate in right angle, apertured flanges such that the flanges of longitudinally abutting end-to-end track sections may be bolted together to form an essentially continuous track.

By recessing the traction surface below the lower ends of the concave sidewalls, the rear drive wheel of the bicycle is prevented from wandering off the traction surface without inhibiting side-to-side motion of the front wheel. The central traction portion may be provided with a high friction traction surface, with abrasive grit molded into the plastic as an upper surface layer of the central traction portion of the unitary track section. Alternatively, an abrasive strip may be adhesively applied to the central traction portion on the upper upwardly facing surface thereof. A plurality of transversely extending, laterally directed, longitudinally spaced narrow slots may be provided within the central traction portion of the track section to permit ready drainage of rain water. Such track slots also allow wind blown sand and grit from the bicycle tires to fall therethrough. The rigid plastic track is relatively weather-proof and maintenance free. Sections having a length on the order of 10-20 feet may be readily dismantled and reinstalled at an another site. The support of the bicycle track sections is preferably from below, using inverted U-brackets which have a transverse base with an upper surface conforming size-wise and shape-wise to the bottom surface of the upwardly open, U-shaped track sections. The bracket top surface terminates at opposite sides in circular projections conforming to the curled lips along the top edges of the track section sidewalls, thereby accepting the projections at the opposite ends of the U-brackets from below, and with the curled lips protecting cyclists from injury, should the cyclists fall during biking. The U-brackets may be mounted directly into the ground, with the base horizontal and with laterally opposed legs on opposite sides of the inverted U-shaped brackets projecting downwardly and having their lower ends penetrating the ground. The U-brackets may be directly anchored by their legs into the ground or supported by stakes driven into the ground, attached to existing objects such as the sides of buildings, pavement, guard rail posts, sides of bridges, etc. Hollow tubular leg sockets terminating at one end in a penetration point are projected into the ground, sized to receive the legs of the inverted U-shaped brackets. Circular collars fitted to the legs and integrated leg sockets have set screws thereof tightened down on the legs at given positions to permit vertical adjustment of respective legs of the U-shaped brackets. Such structure permits readjustment of the position of the brackets at each location over the length of the bicycle track to accommodate for dislodgment of the leg sockets or brackets over time and use of the bicycle track. The collar set screws for tightening down and releasing of the collars readily permit a shift in axial position of the leg of the U-shaped support brackets in bearing the same.

BRIEF DESCRIPTION OF THE DRAWINGS

FIG. 2 is a transverse sectional view through a section of the track shown in FIG. 1 taken about line 2—2;

FIG. 3 is a top plan view of the track section of FIG. 2;

FIG. 4 is a side elevational view of the track section of FIGS. 2 and 3, illustrating the bolting together of coupling flanges at opposite ends of the track sections;

FIG. 4*a* is an end view of a track section of FIG. 4 showing a coupling flange;

FIG. 9 is a side elevational view of the support bracket of FIG. 8;

FIG. 10 is a front elevational view of the in-ground socket receiving one leg of the support bracket in FIG. 8;

FIG. 11 is a plan view of a split head clamp employed in setting the vertical position of a support bracket leg within the in-ground socket of FIG. 10; and FIG. 12 is an end view of the split head clamp of FIG. 11.

FIG. 13 is a perspective view of an expandable mesh track section forming a fourth embodiment of this invention.

DESCRIPTION OF THE PREFERRED EMBODIMENTS

Figure 1:
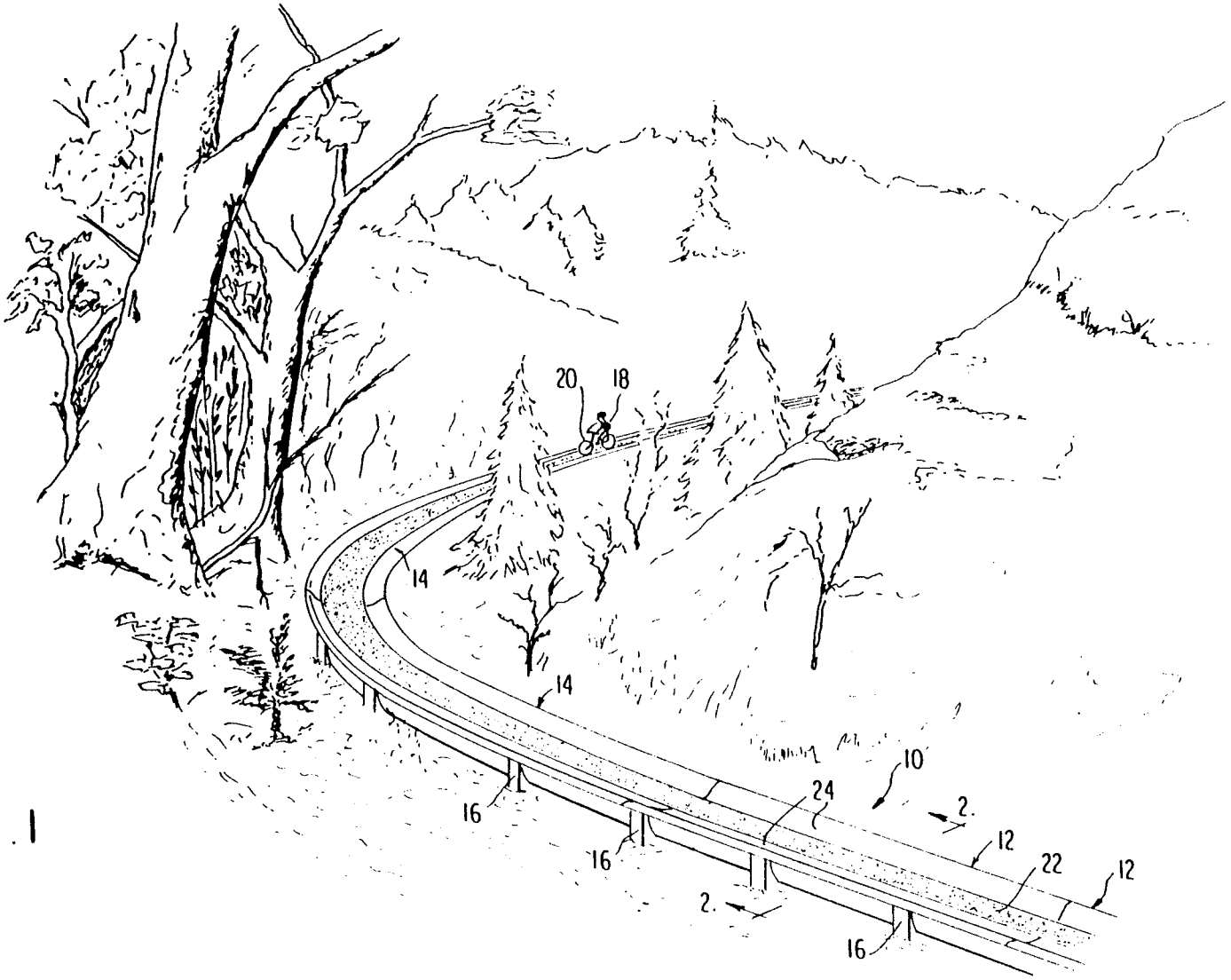
FIG. 1 is a perspective view of the prefabricated, self-guidance bicycle track forming a preferred embodiment of the invention.

FIG. 1 illustrates in a perspective view a self-guidance bicycle track indicated generally at 10 forming a preferred embodiment of the invention. The bicycle track 10 is formed of prefabricated molded plastic sections including a plurality of end-to-end joined, straight sections 12 and a plurality of like joined curved sections, indicated generally at 14. Alternatively, the bicycle track 10 may be of continuous form. However, by making up the bicycle track 10 from preformed and preferably molded plastic sections 12, 14, the track may be taken up and reinstalled. Preferably, the various track sections, whether curving to the right as at 14, or straight as at 12, or curving to the left (not shown), have a similar cross-section. (But not exactly the same—the outer sidewall on curved sections will be higher. Special transition sections will make a smooth change from curved to straight track or from wide to narrow track.

The straight track sections 12 consist of a center traction portion 22 with oppositely facing concave sidewalls 24, thus creating an upwardly open, U-shaped track with a generally flat traction surface 22*a* in the middle. This is preferred, but it is feasible to have integrally molded sidewalls attached to a bottom during assembly. As may be appreciated, the cross-section of the track can vary considerably in shape and dimension, but the sides or sidewalls of the track must be higher than the center traction portion. The sections may be of any convenient length on the order, for example, of 4 m in length and for straight section 12, a lateral width of 78 cm, with a central, flat traction portion on the order of 9 cm in width. The track sections may be of extruded, or poltruded molded plastic, of expandable mesh, or may be compression molded with or without reinforcing fibers such as fiberglass embedded within a suitable thermosetting resin. The plastic resin may be polyvinyl chloride (PVC).

In the illustrated embodiment, the end abutting sections of the track at 12, 14 may be bolted together by bolts passing through right angle, downwardly projecting flanges as will be seen hereinafter. Preferably, the track 10 may be laid on the ground without disturbing the terrain by the use of a plurality of longitudinally spaced brackets as at 16 which are contoured to and which engage the bottom surface of the molded plastic track sections 12, 14, FIG. 1.

Figure 5:
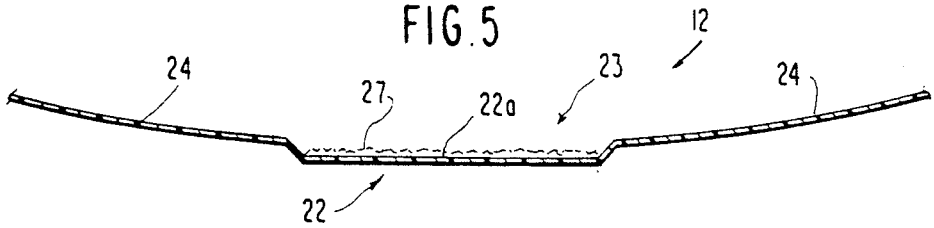
FIG. 5 is a transverse sectional view, in enlarged scale, of a portion of the track section of FIG. 2 including the central traction portion.

As may be seen from FIGS. 2 and 5, the basic bicycle track design, as exemplified by the cross-sectional view FIG. 2, of a straight track section 12 consists of a slightly recessed central traction portion 22 and smooth, curved, mirror image sidewalls 24 to each side thereof. The central traction portion 22 should be recessed relative to the curved sidewalls 24 sufficient enough to prevent the rear drive wheel of a bicycle 20 from wandering off the traction surface 22*a* thereof. In the illustrated embodiment, FIG. 2, the traction surface 22*a* is recessed at a depth D 0.5 cm below the upper surface of the smooth, curved sidewalls 24 which are integral therewith The recess 23, FIG. 2, is not so deep as to inhibit the side-to-side motion of the bicycle front wheel which may ride up onto the upper surface of the concave sidewalls 24 to each side thereof. Of course, the recess 23 may be of a depth considerably greater than 0.5 cm. The flat central traction portion 22 is integrally joined to the sidewalls 24 by oblique transition portions 26 at 45°.

Further, the outboard edges of the concave, curved sidewalls 24 terminate in reverse bent lips 28 defining longitudinally extending cylindrical cavities 30 of a width N of approximately 2 cm. The vertical height H of each sidewall is in the illustrated embodiment 22 cm. The depth D of the recess 23 being equal to 0.5 cm, the lateral width E of each transition portion is 0.5 cm. The lateral width W' of the central track section traction portion 22 is 9 cm, or greater and the overall effective width W of the bicycle track section 12 W is 78 cm. The lips 28 have a radius r equal to 1.525 (just slightly larger than the 1.5 cm radius of the rounded ends of the support bracket which fit inside) in the example shown. The concave sidewalls 24 each have a radius R equal to 40 cm and offset from a reference circle C (as shown in dotted lines, FIG. 2,) by the width of the flat track bottom.

As seen in FIG. 4, the molded plastic track section 12 terminates at opposite ends in flanges 34 at right angles to the longitudinal axis of the track section, the flanges may be of variable height, but must be of sufficient height to include a plurality of circumferentially spaced bolt holes 36. In the plan view, FIG. 3, it may be seen that the concave, upwardly facing sidewalls 24 of the molded plastic straight track section 12, are of equal width, and that further a plurality of longitudinally spaced, transversely extending slots 32 are molded or otherwise formed within track section 12 extending fully across the central traction portion 22 of molded track section 12. The slots in the illustrated embodiment are approximately 0.5 cm wide, extend across the flat traction surface 22*a* and are spaced longitudinally about 4.5 cm. As such, the slots provide drainage and allow wind blown sand and other grit from tires to fall through the track bottom. Preferably, the slots taper outwardly from top to bottom to "self clean". As seen best in the enlarged scale sectional view, FIG. 5, the track surface 22*a* is formed by molding into the plastic material, a thin layer of abrasive grit as at 27. Alternatively, a pressure sensitive adhesive strip provided with an abrasive upper surface may be simply pressed into contact with the molded traction portion 22 of the bicycle track to provide an appropriate traction surface 22*a* within recess 23 of the unitary molded plastic bicycle track. The molded plastic bicycle track 12, 14 may have a central traction surface formed by slotted or mesh design, or raised knobs, dimples, ridges, etc. Or entire track can be of a semi-flexible mesh design which can be stretched and curved as needed during installation.

Molded plastic bicycle track sections having a molded in high friction surface layer as at 22*a* are economical to manufacture, ship and install as prefabricated components and as such are relatively weatherproof and maintenance-free. Since they are uniformly upwardly concave to the same degree, they may be readily nested and stacked for shipment. Such track sections may be readily installed by bolting them together and placing them in overlying position on a suitable underlying support system such as longitudinally spaced brackets 16, as will be discussed hereinafter. In areas where snow and ice are common, the track may be dark colored, such as black, to enhance solar warming and subsequent melting of ice and snow on the track. A protective canopy, and indeed sidewalls, may be added to shield the track from the elements and road spray. The track sections 12 are bolted together at opposite ends by bolts 39, which pass through the aligned bolt holes 36 of abutting flanges 34, FIG. 4. Suitable self locking nuts 41 are threaded to the threaded shanks 43 of bolts 39 complete the assembly. If necessary, flat washers 2 per bolt (not shown) may be applied to the threaded shanks 43 of the bolts 39, prior to threading on nuts 41. As may be appreciated by FIG. 1, where the bicycle track 10 curves, the central track portion 22' is both curved and extended laterally in the direction of the outside sidewall in curved section 14, and the width of the sidewall is reduced on that side. With the central traction surface portion as at 22 for straight track section 12 including a curve matching the normal curvature of the smooth sidewalls to provide proper traction for the cyclist 18 on bicycle 20 when cornering. The traction surfaces may be extended laterally as entry track sections, for example. The flat track central traction portion 22 for straight section 12 of the track may be widened to allow passing of bicycles or for use of three-wheeled cycles, bicycle trailers or the like. Such variances are not limited to straight track sections, but apply equally to curved track sections, arched track sections to match upwardly or downwardly vertical terrain changes, transition track sections, Y or other track intersections and entry and exit track sections.

Figure 6:
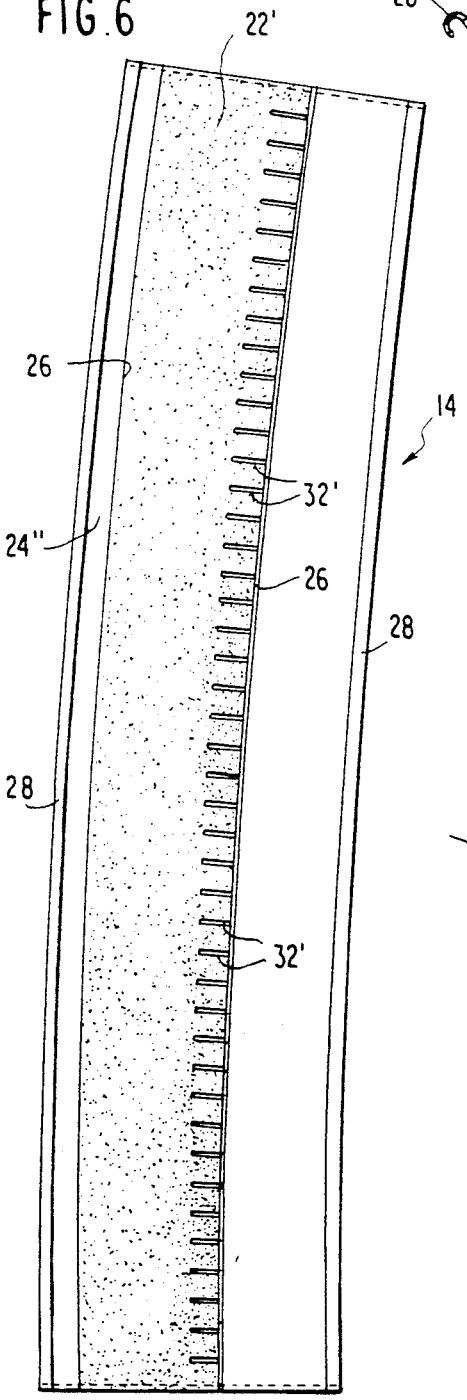
FIG. 6 is a top plan view of a curved track section of the bicycle track of FIG. 1.
Figure 7:
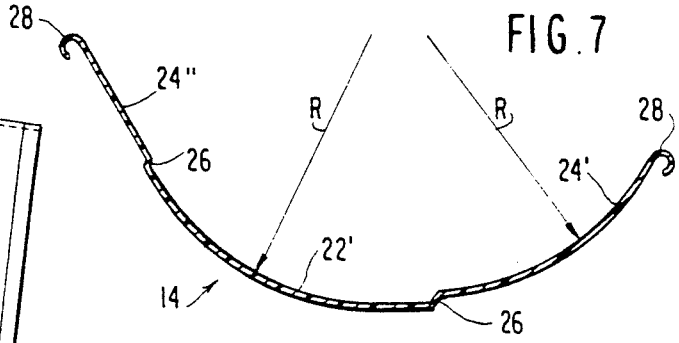
FIG. 7 is a transverse sectional view of the track section of FIG. 6.

FIGS. 6 and 7 show a curved track section 14, FIG. 1, in enlarged scale, with a widening of the central track traction portion 22' and a concave configuration given to outside curve content of that traction section approaching or equal to the normal curvature of the outside sidewall for curved track section 14. In that respect, the longitudinal spacing and lateral width of the slots 32' match that of track section 12, but the slots are located adjacent to the right side sidewall 24' at transition portion 26 in contrast to the much narrower, upwardly oblique, flat, left side sidewall 24''. The same depth is provided to the recessed traction surface 22' and again molded in grit, such as sand, forms a traction surface 22*a* facing upwardly within recess 23 of that track section, FIG. 6. In this case, the left sidewall 24'', instead of being curved, is flat and to the contrary, part of the central traction surface 22' is laterally curved. Further, that smooth, flat, oblique surface portion 24'' is of extended height relative to the right side sidewall 24'. In essence, the normal 9 cm central traction portion, which is flat, is extended by an integral arcuate portion also bearing the high friction grit traction surface 22*a'* as a concave portion at a 40 cm radius R as a right side upwardly concave traction portion, leading to the left side transition portion 26 of the molded plastic curved track section 14, at the 45° angle and of a vertical height of 0.5 cm. In this case, only the 9 cm wide flat central traction portion of the track section 14 is provided with the drainage slots 32' as may be appreciated by viewing FIGS. 6 and 7. As a result, the overall width W'' of the track section 14 is increased to 91.8 cm for the example forming a preferred embodiment of the invention as described herein. The traction surface 22*a'* is extended up the curved sidewall on the outer track radius and the transition portion 26 of the extrusion shifted to the left, FIG. 6, at approximately the same vertical height as the lip 28 to the right of that figure. The transition portions 26 define a recess 23' and act to maintain the bicycle tire of the track cyclist 18 within that recess. By providing adhesive grit over that complete surface area 22*a'*, adequate traction is provided to the bicycle's tires as the bicycle goes through the turn. Preferably, the drainage slots 32', as well as 32 in the straight track section 12, widen slightly from the top surface to the bottom of the extrusion of the track extrusion section to minimize grit clogging. The transition section portion 26 to the left, FIGS. 6, 7, being at a 45° angle, tend to align the bicycle wheels with the upper traction surface 22' and prevent the rear wheel from riding over onto the smooth, flat, oblique surface portion 24'', where the bicycle tire would tend to slip for lack of frictional engagement between the tire tread pattern and the flat, smooth, oblique facing surface of sidewall 24''. The smooth sidewall surface is important to prevent the front wheel from climbing out of the track when it deviates from the traction surface.

Figure 8:
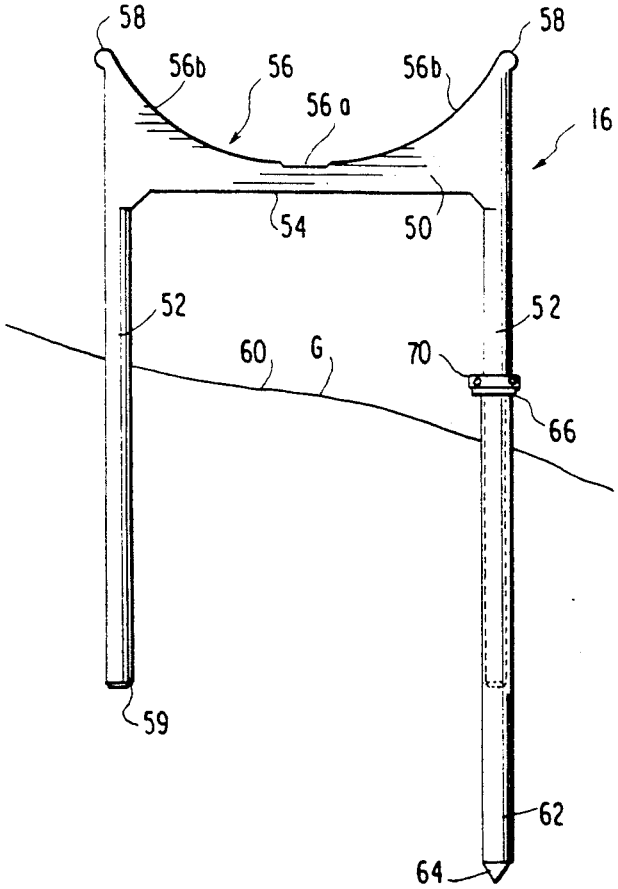
FIG. 8 is a front elevational view of a support bracket for supporting a straight track section of FIGS. 3-5 prior to positioning of a straight track section thereon, and as mounted within the ground at the situs of the bicycle track of FIG. 1.

Referring next to FIGS. 8 and 9, each U-shaped bracket 16 is shown as formed of molded plastic, preferably fiberglass reinforced, of a resin such as polyvinyl chloride (PVC). The U-bracket 16 may be compression molded, may be of a thickness of 5 cm and consists of a base 50, from which projects a pair of bracket legs 52 of the equal length. The legs may be 100 cm in length, the overall height of the bracket 128 cm, the diameter of each of the legs 52 may be equal to the 5 cm width of the support bracket 16. Thus, in cross-section the legs 52 are round. The bracket base 50 has a flat bottom surface 54 and a U-shaped top surface 56, which consists of a central, horizontal, flat recessed surface portion 56*a*, and upwardly concave surface portions 56*b* to each side thereof terminating in rounded, circular projection 58 to each side thereof. Projections 58 are sized to and receivable in elongated circular cross section cylindrical cavity 30 defined by lips 28 of a straight track section 12 fitted thereto. Bracket legs 52 are driven into the ground G. FIG. 8 shows ground line 60 sloping downwardly from left to right. Preferably, the legs (see the leg to the right, FIG. 8,) are slidably positioned within vertically upright, in-ground adjustment sockets indicated generally at 62, which may be formed of sheet metal or molded plastic, having a sharp V-point 64 at its lower end and having internal dimensions slightly in excess of the cross-section diameter of the round cross-section bracket legs 52. Leg 52 is insertably received within the in-ground socket 62 when driven into the ground as per FIG. 8.

While only a single in-ground socket 62 is shown in FIG. 8, another socket may be driven into the ground to the left of socket 62, in line with the center of the left side leg 52 and receiving the same.

For fixing the vertical height of the bracket base 50 above the ground G and with the bottom surface 54 of the base horizontal, a split head clamp 70 or the like be provided on each of legs 52 prior to insertion. The split head clamp as seen in FIGS. 11 and 12 is formed essentially of two metal or plastic head clamp halves 72 which conform on their inside surfaces to the diameter of the support bracket leg. Just one socket is shown in FIG.. 8, but two would normally be used. Those head clamp halves are of elongated form having a front surface 74, a rear surface 76 and laterally opposed end surfaces 78. The rear surface 76 has gaps between the two collar halves which allows for tightening. The gaps face each other for the head clamp halves 72. Further, paired, aligned holes 82 are drilled within the head clamp halves from the front surface 74 through the rear surface, which holes 82 receive bolts 84. The bolts have threaded shanks and are of a length such that threaded ends 84*a* project beyond the end of the holes 82 within the other half receiving the bolts. Nuts 86 are threaded onto the projecting bolt ends 84*a*. With the halves partially separated as shown in FIG. 11, the annular hole formed by the opposing adjustment gaps, between the two collar halves and their concave inner surfaces is of a diameter sufficiently large so as to permit the split head clamp to be slid onto the bracket leg 52 as per FIG. 8. The split head clamp 70 is separate from the in-ground socket, and by opening up or separating the halves 72 from each other, may be slid up and down a support bracket leg 52 and then tightened firmly against a leg at a desired longitudinal portion by rotation of bolts 84. With the split head clamp 70 tightened firmly at a preset position on a support bracket leg 52, contact between the bottom of the split head clamp 70 and the top of the in-ground socket 62 prevents further downward movement of the bracket leg 52 within an in-ground socket.

The in-ground socket 62 is embedded in the ground with the aid of an alignment jig and driving rod which conforms to the inside of the socket 62. The adjustment sockets and split head clamps allow for final vertical track alignment and periodic adjustments to compensate for settling of the track system and heaving of the ground as a result of frost. The track and support brackets can easily be removed from the in-ground sockets so that the grass may be mowed or the track put into storage in the off-season.

As evidenced in FIG. 10, an integral collar 66 is preferably formed on the in-ground socket 62 at its upper end as a radially enlarged flange. Preferably, a hex head set screw is threaded into a tapped hole 69, which extends horizontally through the collar 66 from the outside to the inside. By rotation of the hex head set screw 68, the engagement between a shank end of the hex head set screw and the facing surface of bracket leg 52 secures the support bracket leg in the socket 62 to prevent accidental lifting of bracket leg from the socket by wind or other forces.

The hex head set screw and collar may act in conjunction with, the split head clamp 70 as per FIGS. 11, 12.

Note

Both the split head clamp and the set screw collar are required and perform different functions. The split head clamp is for height adjustment while the set screw collar on the in-ground socket simply prevents accidental lifting of the leg from the socket. The set screw is not sufficient to hold the leg in position when subjected to downward forces.

A slight chamfer is given at 59 at all around to the end of the round cross-section bracket leg 52 to facilitate insertion of the lower end of the bracket leg 52 into the open top of the in-ground sockets 62, i.e. at collar 66, FIG. 10, during assembly of the support bracket to its in-ground sockets 62.

While the preferred track section dimensions are described above, particularly with respect to a track 10 constructed of end-to-end abutting and coupled straight track sections 12 and curved track sections 14, the functional track may have sidewall radii in the range of 12 cm to 46 cm (5 inches to 18 inches). Overall track width may range from 15 cm to 350 cm. The width of track depends on its intended use, i.e. single lane, passing lane, corner. It would appear that the narrowest practical width for a straight, single lane track section is about 80 cm (31.5 inches), but it is theoretically possible to reduce the track width down to as little as 15 cm (6 inches). Prefabricated bicycle tracks similar to that illustrated at 10, FIG. 1, may employ a number of standardized basic components such as the single lane, straight track sections 12 for one-way bicycle travel; a passing lane straight track section wide enough to allow passing in the same direction of two cyclists; or a special width, straight track section for permitting the use of three-wheeled cycles and bicycles with bicycle trailers coupled thereto.

Curved track sections such as right hand curved sections 14, FIG. 1, provide for a horizontal curve without rise or drop in slope. The curved track sections 14, FIG. 1, are merely examples. Various standard radii curved track sections may be provided as stock items, with others made to order. Curved track sections may be of the single lane variety as shown at 14 in FIG. 1 for one-way bicycle travel, or as special width curved track sections which allow use of three-wheeled cycles and bicycles with attached bicycle trailers.

Similarly, arched track sections having a bend in terms of vertical height combined with various standard lateral bend radii form alternatives and may be of the single lane, passing lane or special width varieties similar to the straight track sections and curved track sections. The same is true for transition track sections which initiate a change from a straight lane single track to a curved single track and vice versa; from a passing lane width to a single track width and vice versa; and from a straight special width track section to a curved special width track section and vice versa. Y-track sections permitting intersections of two tracks or as a modification entry and exit track sections permitting bicycles to enter and leave the track may be provided both in the single lane and special width categories.

In addition to the various track sections described above and built in conjunction with the illustrated straight sections within the drawings and described herein, the next most important aspect of the track system of the present invention is the support brackets which have been discussed in some detail and are illustrated particularly in drawing FIGS. 8 and 9. It should be kept in mind that since the track sections are coupled together at right angle flanges which depend downwardly from the bottom surfaces of the molded plastic sections at opposite ends and which are bolted together, when placement of the track sections onto the brackets, the brackets can be aligned with flanged couplings between track sections and to a side thereof. Thus the lateral contact therebetween prevents the tendency for the track sections to shift in the direction of their longitudinal axis during usage. The support brackets, therefore, cooperate with the flanged ends of the track sections to rigidity the track after assembly.

With respect to the support brackets, the standard support brackets for use with straight track sections having been shown in FIGS. 8 and 9, it may be appreciated that support brackets similarly built and of nearly the same dimension are provided for the curved track sections such as 14, in which case only the upper surface 56 of the bracket 50 is varied to conform in size and configuration to the bottom surface of the molded plastic curved track section which is fitted thereto and maintained thereon by gravity and by the curled lips (28) snapping over the rounded, circular projections (58) on each side of the support brackets (FIG. 8). The invention also envisions the utilization of three-way adjustable brackets for installations on unstable ground, double brackets for side-by-side track installations, where one track services riders going in one direction, and the other riders going in the opposite direction. Cantilevered, side-mounted brackets may be employed for mounting track sections to vertical features such as sides of bridges, guardrails, buildings and rock faces or the like. A plurality of support brackets rigidly linked in tandem pairs, and with cable attachment points at each of the four corners will allow suspension of a track on parallel cables for crossing over rivers, ravines, roads, etc.

Bike track 10' using expandable mesh 12', as per FIG. 13, may be shipped in compressed from then stretched into shape during installation. Cross sectional shape of installed sections will be the same as for solid track sections except for the 2–4 cm mesh depth which will give expanded track a greater thickness.

The expanded mesh design will allow sufficient bending to accommodate most horizontal and vertical curve radii and can be bent to the desired curve on site. The support brackets previously described will hold the track in proper alignment once installed. Flexible U-shaped lengths of molding can be slipped onto the upper edges of the track to protect bicyclists from rough track edges.

The expandable mesh design provides significant cost savings in manufacturing and installation. But will provide a lower quality riding surface when compared to track made from solid sections. The expanded mesh track 12' may be converted into a permanent installation with improved riding characteristics by filling the open mesh with a material such as cement which could be smoothed into the mesh then allowed to harden. Occasional mesh openings would be left in the bottom for drainage.

The sample shown above is typical of how the mesh would appear in the flat bottom of the track after it is expanded for installation. Since mesh cells 106 must keep the same orientation throughout the track to allow stretching and bending, the mesh cells 106 on the upper sidewalls 12' of the track would be longer and the mesh openings would be cut at an oblique angle.

It is envisioned that various accessories may be added to the bicycle track 10 of the present invention to enhance performance and to increase safety for the cyclists 18. Such accessories may be clamped or otherwise secured to the bicycle track sections 12, 14 and support brackets 16. Typical of such accessories are flared track entrances to aid in aligning bicycles with the track; flat (horizontal) side surfaces for pedestrian use and/or as dismounting surfaces for increased safety and convenience of cyclists; safety railings to prevent falls from elevated track and/or to provide a visual barrier for adjacent motor vehicles; protection barriers to provide screening to cyclists and pedestrians (if equipped with pedestrian surfaces) from dust, dirt, spray, noise, fumes and vehicle drafting when the track is adjacent to highways and may also be used as a windbreak on exposed sections of a track. Separately supported canopies may be provided for protection from the elements. Spring loaded prongs angled in the direction of travel, i.e. oblique to the traction surfaces of the track sections, may be placed at a track exit to discourage cyclist entrance onto the track 10 in opposition to the normal travel direction.

From the system as proposed, there would appear to be certain disadvantages. Bicycles may only travel one way on the track for the straight and curved sections 12, 14 as depicted. Thus, most situations would require the installation of two tracks, one for each direction of travel, appropriately supported by double, i.e. side-by-side dual support brackets for lowering of cost. Passing of cyclists is limited to locations where a wide track for passing is provided, or where the track exits onto broad, flat surfaces. Such tracks necessarily eliminate pedestrians and their pets, unless the track sections are equipped with flat side surfaces discussed above. These, however, may be an advantage, since the cyclists do not have to weave around slower moving pedestrians, and do not risk head on collisions with other cyclists.

Importantly, there is a large number of advantages of the self-guidance bicycle track as disclosed. The self-guidance bicycle track is less expensive than construction of bicycle paths to AASHTO Standards, provide superior safety and cycling efficiency, can be quickly installed, and provide smooth, firm surface with excellent drainage combined with excellent traction. Formed of molded plastic, the track sections are weather-resistant, do not require excavation, provide minimal disruption of existing vegetation, does not adversely affect the drainage of the installation site and can be installed on steep side slopes.

The sections and the support brackets for supporting the same in standard or modified form can be installed on the side of existing structures such as buildings, guardrails, bridges, the sections can be hand-carried to the installation site, can be erected with simple hand tools, thereby eliminating soil compaction, rutting and erosion common on unimproved trails. The track 10 can be easily removed and reused allowing for seasonal installation or relocation to another site, and can be removed in terms of minutes for special cases where vehicles must cross the track installation. Since the cyclists are required to stay on the track, they do not wander into vehicular traffic. Cyclists constrained to the track are thus freer to sightsee and need pay less attention to their direction of travel. The well-drained non-slip track surface permits cycling in poor weather without fear of falling or slippage, and the track is easy to ride at night due to the self-guiding characteristic of the track sections, can be used easily by unmodified bicycles, and reduces collisions between cyclists and objects near the bicycle paths.

Various modifications of detail, advised by circumstances and practice, may be introduced to the examples described above, are embodied by the present invention as long as those variations introduced do not change, alter or modify the essence of the embodiment described.

Although the present invention has been described in connection with a preferred embodiment thereof, many other variations and modifications may be apparent to those skilled in the art. It is preferred, therefore, that the present invention be limited not by the specific disclosure herein, but only by the pendent claims.

What is claimed is:

1. A self-guidance bicycle track mountable directly to natural or manmade terrain of varying height and slope, said track comprising at least a semi-rigid elongated structure of upwardly open U-shaped form including a central traction portion having an upper surface of relatively high friction and concave, laterally opposed sidewalls to laterally opposite sides of said central traction portion.

2. The bicycle track as claimed in claim 1, wherein said central traction portion is recessed below the laterally opposed sidewalls forming transition portions which offset said central traction portion from the sidewalls and define barriers tending to prevent a rear wheel of a bicycle from riding up and over the transition portions onto the sidewalls of the bicycle track.

3. The bicycle track as claimed in claim 1, wherein said at least semi-rigid elongated structure comprises a plurality of molded plastic track sections having opposite ends in abutment and means coupling said molded plastic track sections together end-to-end.

4. The bicycle track as claimed in claim 2, wherein said rigid elongated structure comprises a plurality of molded plastic track sections having opposite ends in abutment and means coupling said molded plastic track sections together end-to-end.

5. The bicycle track as claimed in claim 3, wherein said central traction portion of each molded plastic track section having a molded in grit upper surface layer forming said high friction traction surface.

6. The bicycle track as claimed in claim 4, wherein said central traction portion of each molded plastic track section having a molded in grit upper surface layer forming said high friction traction surface.

7. The bicycle track as claimed in claim 5, wherein said laterally opposed sidewalls terminate in edges, remote from central track portion in reversely directed, arcuate, downwardly facing lips.

8. The bicycle track as claimed in claim 6, wherein said laterally opposed sidewalls terminate in edges, remote from central track portion in reversely directed, arcuate, downwardly facing lips.

9. The bicycle track as claimed in claim 3, wherein said central traction portion includes longitudinally spaced, transverse slots extending therethrough and permitting rain water to drain from the upwardly open U-shaped form track.

10. The bicycle track as claimed in claim 4, wherein said central traction portion includes longitudinally spaced, transverse slots extending therethrough and permitting rain water to drain from the upwardly open U-shaped form track.

11. The bicycle track as claimed in claim 7, wherein said central traction portion includes longitudinally spaced, transverse slots extending therethrough and permitting rain water to drain from the upwardly open U-shaped form track.

12. The bicycle track as claimed in claim 8, wherein said central traction portion includes longitudinally spaced, transverse slots extending therethrough and permitting rain water to drain from the upwardly open U-shaped form track.

13. The bicycle track as claimed in claim 9, wherein said longitudinally spaced transverse slots have oppositely facing transverse sidewalls which are oblique, outwardly and downwardly away from each other to prevent accumulation of dirt within the sidewalls tending to prevent drainage of the upwardly open U-shaped bicycle track.

14. The bicycle track as claimed in claim 3, wherein said molded plastic track sections have flanges at opposite ends thereof which project downwardly therefrom parallel to each other and at right angles to the plane of the central traction portion, and wherein said flanges have circumferentially spaced holes therethrough, said holes within said flanges of adjacent molded plastic track sections being aligned, and bolts projecting through said aligned holes at circumferentially spaced locations and bearing nuts on threaded shanks thereof and rigidly coupling said track sections together to form a stable, rigid track for mounting to said terrain.

15. The bicycle track as claimed in claim 3, further comprising a plurality of U-shaped brackets underlying said molded plastic track sections extending transversely to the longitudinal axis of the coupled upwardly open U-shaped track section, said brackets including a transverse base having an upper surface conforming size-wise and shape-wise to the bottom surface of the upwardly open U-shaped track section and having laterally opposed, integral legs projecting downwardly from a bottom surface of the base for penetrating said terrain such that the end-to-end coupled track sections are snapped into and supported within the U-shaped upper surface of the support brackets of the base of the support brackets underlying the same.

16. The bicycle track as claimed in claim 15, further comprising at least one hollow tubular leg socket for each U-shaped support bracket mounted within said terrain extending and vertically upwardly therewith and slidably receiving a leg of said U-shaped support bracket, said hollow tubular leg socket being configured and sized so as to closely slidably receive the leg of the U-shaped bracket, and means carried by one of said tubular leg sockets and said U-shaped bracket leg for selectively limiting the extent of insertion of the leg into the hollow tubular leg socket, thereby fixing the vertical height of the U-shaped support bracket relative to the terrain and the vertical height of the track section carried thereby, and facilitating subsequent readjustment of track height.

17. The bicycle track as claimed in claim 16, wherein said hollow tubular leg socket terminates at its upper end in a radially enlarged collar, a set screw threadedly mounted to said circular collar, projecting therethrough and having a threaded shank engagable with a side of the inserted leg of the U-shaped support bracket such that tightening down of the set screw on the bracket leg fixes the leg at a given insertion position within said hollow tubular leg socket, and prevents accidental lifting of the bracket leg from the tabular leg socket.

18. The bicycle track as claimed in claim 16, wherein said means for fixing the vertical height of the inserted bracket leg within the hollow tubular leg socket comprises a split clamp formed of planar head clamp halves having front and rear surfaces and opposite ends, said rear surface including a central recess therein, said split head clamp halves including holes adjacent said opposite ends through said head clamp halves, aligned with each other, to the lateral sides of said recess within the rear surface, the recesses being sized such that with the clamp halves having the rear surfaces in near abutment, the opening formed by the oppositely facing recesses is sized to receive a bracket leg, the split head clamp being slidably mounted on the leg of the U-shaped support bracket intermediate of the base and the in-ground socket and bolts extending through the aligned holes of the facing split head clamps, with the bolts tightened down to frictionally lock the split head clamp on the legs of the U-shaped support bracket legs, thereby limiting penetration of the hollow in-ground tubular socket by said legs and setting the vertical height of an U-shaped support bracket relative to the terrain, and the vertical position of the molded plastic track section supported by the U-shaped support bracket.

* * * * *